US011448155B2

(12) United States Patent
Zielke

(10) Patent No.: US 11,448,155 B2
(45) Date of Patent: Sep. 20, 2022

(54) PROCESS FOR TESTING A PLURALITY OF COMPONENTS OF AN EXHAUST GAS AFTERTREATMENT SYSTEM

(71) Applicant: Robert Bosch GmbH, Stuttgart (DE)

(72) Inventor: Robert Manfred Zielke, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/986,417

(22) Filed: Aug. 6, 2020

(65) Prior Publication Data

US 2021/0040912 A1 Feb. 11, 2021

(30) Foreign Application Priority Data

Aug. 9, 2019 (DE) ..... 10 2019 212 025.3

(51) Int. Cl.

| | |
|---|---|
| ***F01N 11/00*** | (2006.01) |
| ***F02D 41/22*** | (2006.01) |
| ***F01N 3/20*** | (2006.01) |
| ***F02D 41/14*** | (2006.01) |

(52) U.S. Cl.

CPC ..... *F02D 41/222* (2013.01); *F01N 3/208* (2013.01); *F01N 11/00* (2013.01); *F02D 41/1463* (2013.01); *F01N 2390/02* (2013.01); *F01N 2560/026* (2013.01); *F01N 2900/0416* (2013.01); *F01N 2900/1814* (2013.01)

(58) Field of Classification Search

CPC .. F01N 11/00; F01N 13/0093; F01N 2390/02; F01N 2550/14; F01N 2560/026; F01N 2610/02; F01N 2900/0416; F01N 2900/1812; F01N 2900/1814; F01N 3/2066; F01N 3/208; F02D 41/024; F02D 41/1463; F02D 41/222

See application file for complete search history.

(56) References Cited

U.S. PATENT DOCUMENTS

| | | | | |
|---|---|---|---|---|
| 2017/0051654 | A1* | 2/2017 | Gupta | F01N 3/035 |
| 2017/0122159 | A1* | 5/2017 | Bahrami | F01N 3/035 |
| 2017/0130629 | A1* | 5/2017 | Nagel | F01N 3/035 |

FOREIGN PATENT DOCUMENTS

DE 102012211703 * 1/2014

* cited by examiner

*Primary Examiner* — Mahmoud Gimie
*Assistant Examiner* — Diem T Tran
(74) *Attorney, Agent, or Firm* — Michael Best & Friedrich LLP

(57) ABSTRACT

A process for testing a plurality of components of an exhaust gas aftertreatment system (100) is disclosed, wherein the plurality of components comprises a first SCR catalyst and at least one further SCR catalyst arranged downstream of the first SCR catalyst in the flow direction of exhaust gas to be passed through the exhaust gas aftertreatment system, a first NOx sensor assigned to the first SCR catalyst and at least one further NOx sensor and a first DeNOx element assigned to the first SCR catalyst and at least one further DeNOx element and wherein the process comprises at least the following steps: conditioning the SCR catalysts, testing the NOx sensors, testing the DeNOx systems testing a storage capacity for the reductant of the SCR catalysts.

17 Claims, 3 Drawing Sheets

PROCESS FOR TESTING A PLURALITY OF COMPONENTS OF AN EXHAUST GAS AFTERTREATMENT SYSTEM

BACKGROUND OF THE INVENTION

The invention relates to a process for testing a plurality of components of an exhaust gas aftertreatment system. The invention further relates to a control unit and a computer program product.

In order to meet national emissions limits, especially in respect of nitrogen oxide (NOx) emissions, the exhaust gases of internal combustion engines are subjected to an exhaust gas aftertreatment. These employ SCR catalysts (SCR=selective catalytic reduction) in which nitrogen oxide molecules are reduced to elemental nitrogen using ammonia ($NH_3$) which serves as the reductant. To provide the reductant, a urea-water solution (UWS) is added to an exhaust tract of an internal combustion engine by means of a DeNOx system upstream of an SCR catalyst. An addition rate is determined by an electronic control unit in which rules for operation and monitoring of the exhaust gas aftertreatment system are stored.

Regulatory rules require onboard diagnostics (OBD), i.e. monitoring on the move. This may employ a signal from at least one NOx sensor which is arranged downstream, i.e. after the SCR catalyst in the flow direction of exhaust gas passed into an exhaust tract by an internal combustion engine. If exceedance of emissions limits is detected via an OBD function, a driver is provided with a prompt advising him or her to find a garage. There, suitable measures are used to perform a diagnosis down to the level of the smallest replaceable units. Such a diagnosis is very costly and inconvenient in a non-automatic process. If a component is found to be defective this may be replaced or repaired.

SUMMARY OF THE INVENTION

The present invention proposes a process for testing a plurality of components of an exhaust gas aftertreatment system, a control unit for performing such a process and a computer program product. Further features and details of the invention are apparent from the respective subclaims, the description and the drawings. It will be appreciated that features and details described in connection with the process according to the invention also apply in connection with the control unit according to the invention and the computer program product according to the invention and vice versa so that reciprocal reference is always, or may always be, made in respect of the disclosure of the individual aspects of the invention.

The specified invention is especially used for diagnosing an exhaust gas aftertreatment system of an internal combustion engine.

A process for testing a plurality of components of an exhaust gas aftertreatment system is accordingly specified. It is provided that the plurality of components comprises a first SCR catalyst and at least one further SCR catalyst arranged downstream of the first SCR catalyst in the flow direction of exhaust gas to be passed through the exhaust gas aftertreatment system, a first NOx sensor assigned to the first SCR catalyst and at least one further NOx sensor and a first DeNOx element assigned to the first SCR catalyst and at least one further DeNOx element. It is provided that the proposed process comprises at least the following steps:

a) conditioning the SCR catalysts, wherein the SCR catalysts are heated above a predetermined threshold value to empty them of reductants using an internal combustion engine, b) testing the NOx sensors, wherein if a deviation of measured values determined by a respective NOx sensor from a reference value is greater than a predetermined threshold value the respective NOx sensor is marked as defective, c) testing the DeNOx systems, wherein if a change in measured values determined by a respective NOx sensor caused by an amount of reductant added via a respective DeNOx element is smaller than a threshold value chosen according to the added amount of reductant the respective DeNOx element is marked as defective, wherein the NOx sensor is arranged downstream of the respective DeNOx system in the flow direction of exhaust gas to be passed through the exhaust gas aftertreatment system, in particular downstream of an SCR catalyst assigned to the respective DeNOx element, d) testing a storage capacity for the reductant of the SCR catalysts, wherein if a change in measured values determined by a respective NOx sensor arranged downstream of the respective DeNOx element in the flow direction of exhaust gas to be passed through the exhaust gas aftertreatment system caused by an amount of reductant added via a DeNOx element of a respective SCR catalyst differs from a predetermined catalyst threshold value the respective SCR catalyst is marked as defective and wherein the steps c) and d) are sequentially repeated for components of the exhaust gas aftertreatment system correspondingly present in multiplicate.

In the context of the specified invention marking as defective is to be understood as meaning a procedure in which a control unit is used to characterize as defective a respective component to be marked as defective using an error code for example. For this purpose, the error code may be stored in the respective component itself, in the control unit and/or in an error storage means.

In the context of the specified invention a DeNOx element is an element such as for example an addition point of a DeNOx system for adding reductant to an exhaust gas aftertreatment system. A DeNOx element especially comprises a pump, a valve and a control unit, wherein the control unit may be for example a central control unit of an internal combustion engine. A DeNOx system may comprise a plurality of DeNOx elements which are provided with reductant by a central pump.

In the context of the specified invention a reference value is a calculated model value from combustion parameters or a measured value from a sensor or an average of measured values from a number of sensors.

The proposed process is based on sequential testing of respective components of an exhaust gas aftertreatment system. Especially in the case of so-called double injection systems, i.e. systems having two DeNOx systems for adding reductant to an exhaust tract, the proposed process can test the different DeNOx systems separately/independently of one another so that conclusions about the health/the functionality of a respective DeNOx system may be drawn.

The proposed process commences with a conditioning in which all SCR catalysts in an exhaust gas aftertreatment system are emptied of reductants, for example aqueous ammonia solution. This may be achieved by increasing a temperature of the exhaust gas aftertreatment system, in particular a temperature of the SCR catalysts, to at least 300° C., in particular to at least 400° C., to achieve rapid decomposition of reductant that may be stored in the SCR catalysts. To this end an internal combustion engine connected to the exhaust gas aftertreatment system may be switched to a heating mode for example. It is especially provided that the internal combustion engine is controlled such that none of the SCR catalysts is heated to a temperature of above 500° C. It will be appreciated that the SCR catalysts may be heated using a heating system, for example an electrical heating, in addition or alternatively to the use of an internal combustion engine.

A second step b) of the proposed process comprises testing respective NOx sensors to detect sensor health and/or any sensor/raw emissions errors. Testing preferably comprises comparing a stationary value from a NOx sensor arranged upstream or downstream of an SCR catalyst with a reference value determined by means of a mathematical model for example. Alternatively or in addition measured values from a plurality of NOx sensors may be compared with one another.

If a comparison of measured values from a NOx sensor with a reference value reveals a deviation, further diagnostic measures can determine an error source within the NOx sensor. Known methods of onboard diagnosis may be employed here. If no deviation is detected, testing can or must be continued.

Continuing testing assumes a functioning NOx sensor system since this forms the basis for further evaluation. In the case of an error or defect in a NOx sensor it is provided that said sensor is repaired or replaced before the proposed process is continued.

In the context of the proposed process at least one individual test on a component of an exhaust gas aftertreatment system is performed. If a respective component is detected as an error source/marked as defective testing may be terminated. Otherwise, the process is continued to further narrow down an error source by process of elimination. This procedure is known as "pinpointing".

It is especially provided that the proposed process proceeds automatically as a result of which the proposed process is particularly cost-efficient and the reproducibility of measurement is ensured, thus allowing unambiguous assignment of any detected errors to respective components.

Step c) comprises testing a respective DeNOx element for errors in an added amount of reductant. Measured values from a NOx sensor measured upstream of an SCR catalyst assigned to the DeNOx element are used to calculate an amount of reductant necessary to reduce NOx emissions downstream of the SCR catalyst to a predetermined level/a predetermined concentration. This may especially be done using a sub-stoichiometric amount of reductant of approximately half of the amount necessary to reduce the NOx emissions below a predetermined catalyst threshold value, thus ensuring that even an aged SCR catalyst achieves complete conversion of reductant so that testing of the DeNOx system is independent of a storage capacity of the SCR catalyst.

Upon detecting a deviation of measured values from a NOx sensor arranged downstream of the SCR catalyst from a reference value the DeNOx element to be tested may be marked as defective and for example subjected to detailed diagnosis in a further pinpointing process. Measured values from the NOx sensor that are too high or too low indicate addition amounts of the reductant that are too small and too large respectively.

Step d) comprises testing a respective SCR catalyst by adding a superstoichiometric amount of reductant to the SCR catalyst which may be for example double the amount of reductant that would be necessary to refill the SCR catalyst with reductant.

If respective measured values determined by a NOx sensor arranged downstream of the SCR catalyst to be tested do not increase or increase merely in a value range below a reference value chosen according to the added amount of reductant as a response to the addition of the reductant, the SCR catalyst may be marked as defective. Measured values from the downstream NOx sensor are typically "nil". An increase in the measured values during continuous superstoichiometric addition of reductant results from overfilling of the SCR catalyst and accompanying NH3 slip. The proposed process is especially performed using measured values within a time window extending from a commencement time point. If a change in the measured values, i.e. NH3 slip, occurs within the time window it may be assumed that the SCR catalyst is defective. If no change in the measured values occurs, and NH3 slip does not occur within a defined time period, the SCR catalyst is in order.

It may be provided that the catalyst threshold value comprises a predetermined time point after an addition time point for addition of the amount of reductant, a single value for comparison with an absolute value of the change in the measured values from the NOx sensor evaluated in step d) and/or a value progression for comparison with an increase in the change in the measured values from the NOx sensor evaluated in step d).

A respective SCR catalyst may be tested by evaluation of an alteration time which elapses before measured values from a NOx sensor arranged downstream of the SCR catalyst are altered after addition of a superstoichiometric amount of reductant. Accordingly a corresponding catalyst threshold value may comprise a temporal threshold value which may be chosen for example according to a target capacity of the SCR catalyst. If the measured values from the NOx sensor change before the temporal threshold value, it can be assumed that the SCR catalyst does not have the target capacity and is thus to be marked as defective.

Furthermore, a respective SCR catalyst may be tested by evaluation of an absolute value from a progression of measured values from a NOx sensor arranged downstream of the SCR catalyst after addition of a superstoichiometric amount of reductant. Accordingly a corresponding catalyst threshold value may comprise an absolute threshold value which may be chosen for example according to a target capacity of the SCR catalyst. In case of a maximum change in the measured values from the NOx sensor that is greater than the absolute threshold value, it can be assumed that the SCR catalyst does not have the target capacity and is thus to be marked as defective.

Furthermore, a respective SCR catalyst may be tested by evaluation of a progression of, or an increase in, measured values from a NOx sensor arranged downstream of the SCR catalyst after addition of a superstoichiometric amount of reductant. Accordingly a corresponding catalyst threshold value may comprise a progression threshold value which may be chosen for example according to a target capacity of the SCR catalyst. In case of a change in the measured values from the NOx sensor corresponding to a progression that differs from the progression threshold value, it can be assumed that the SCR catalyst does not have the target capacity and is thus to be marked as defective. To this end a gradient function or a derivative function of the progression of the measured values may be evaluated for example.

It may be provided that the sequential repetition of the steps c) and d) commences with a respective component arranged furthest from an exhaust gas source in the flow direction of exhaust gas to be passed through the exhaust gas aftertreatment system before respective subsequent components in the direction of the exhaust gas source are tested successively or commences with a respective component (105) arranged closest to an exhaust gas source in the flow direction of exhaust gas to be passed through the exhaust gas aftertreatment system (100) before respective subsequent components (115, 113, 103) in the flow direction are tested successively.

The proposed process especially provides that the steps c) and d) are sequentially repeated for components of the exhaust gas aftertreatment system correspondingly present in multiplicate. This means that the steps c) and d) are performed for example for a first NOx sensor, a first DeNOx system and a first SCR catalyst and subsequently for a second NOx sensor, a second DeNOx element and a second SCR catalyst. The first NOx sensor, the first DeNOx element and the first SCR catalyst are advantageously chosen such that they are arranged downstream of the second NOx sensor, the second DeNOx system and the second SCR catalyst so that emissions generated during testing of the first NOx sensor, the first DeNOx system and the first SCR catalyst, which flow downstream, do not affect a subsequent testing of the second NOx sensor, the second DeNOx system and the second SCR catalyst.

It is alternatively possible to first test respective components closest to the internal combustion engine. Since the components closest to the internal combustion engine are subjected to particularly high temperatures these are generally particularly failure prone and thus particularly relevant to a diagnosis.

It will be appreciated that the proposed process may also be performed with exhaust gas aftertreatment systems comprising merely one DeNOx element used for adding reductant to a plurality of SCR catalysts.

If no error source is found but a lack of efficiency of the DeNOx system is detected in step c) this points to an insufficient quality of the reductant.

The proposed process may in principle be expanded to any desired number of n_SCR catalysts having an accompanying number of n_DeNOx systems and n_NOx sensors. Typically, n_SCR=n_DeNOx systems=n_NOx+1 but this is not mandatory for performing the proposed process.

After completed testing and/or repair of a respective exhaust gas aftertreatment system a corresponding OBD system must generally be reset ("service quality healing"). This is nowadays typically accomplished by performing a longer test drive during which the OBD system automatically resets by deleting respective errors. In comparison thereto, the proposed process has the advantage that such a test drive is no longer necessary.

The process according to the invention is therefore advantageously used to detect a defect-free system and/or to reset an onboard diagnostics apparatus after completed repair.

It is conceivable for step a) to additionally comprise testing respective SCR catalysts. This may be carried out for example via a progression diagnosis of measured values from a NOx sensor assigned to a respective SCR catalyst which may be indicative of potential deposits and/or incorrect fill levels of the SCR catalyst.

It may be provided that initially all NOx sensors are tested in step b), subsequently all DeNOx systems are tested in step c) and finally all SCR catalysts are tested in step d).

Through successive testing of respective groups of components interaction of defects between the groups of components during performance of the proposed process can be avoided. Initial testing of the NOx sensors in particular makes it possible to avoid erroneous determination of measured values which could result in false negative testing of DeNOx systems and SCR catalysts.

Likewise upstream/initial testing of respective DeNOx systems avoids false negative testing of respective SCR catalysts.

It may be provided that the proposed process is performed in a servicing mode of an internal combustion engine comprising the exhaust gas aftertreatment system.

The proposed process is preferably performed under defined, constant operating conditions, in particular at constant engine speed, temperature and/or addition amount. This is especially possible when the process is performed in a garage or at least under garage-like conditions and no manual intervention of a garage worker is necessary. This makes it possible to achieve reliable results that allow unambiguous pinpointing.

The process may also be performed according to a computer program running in a control unit or a garage tester. The control unit may be for example an engine control unit or a control unit of an SCR catalyst. This makes it possible to achieve a high degree of automation. Reproducibility is also ensured.

In a further aspect the proposed invention relates to a control unit configured for running the proposed process.

It may especially be provided that the control unit is configured to perform testing of a plurality of components of an exhaust gas aftertreatment system, wherein the plurality of components comprises a first SCR catalyst and at least one further SCR catalyst arranged downstream of the first SCR catalyst in the flow direction of exhaust gas to be passed through the exhaust gas aftertreatment system,

- a first NOx sensor assigned to the first SCR catalyst and at least one further NOx sensor assigned to the at least one further SCR catalyst and
- a first DeNOx element assigned to the first SCR catalyst and at least one further DeNOx element assigned to the at least one further SCR catalyst and wherein the control unit is configured for performing at least the following steps:

a) conditioning the SCR catalysts by heating the SCR catalysts above a predetermined threshold value to empty them of reductants using an internal combustion engine to be controlled by the control unit, b) testing the NOx sensors, wherein if a deviation of measured values to be determined by a respective NOx sensor from a reference value is greater than a predetermined threshold value the respective NOx sensor is marked as defective, c) testing the DeNOx systems, wherein if a change in measured values to be determined by a respective NOx sensor arranged downstream of the respective DeNOx element in the flow direction of exhaust gas to be passed through the exhaust gas aftertreatment system caused by an amount of reductant to be added via a respective DeNOx element differs from a predetermined threshold value the respective DeNOx element is marked as defective, d) testing a storage capacity for the reductant of the SCR catalysts, wherein if a change in measured values to be determined by a respective NOx sensor arranged downstream of the respective DeNOx element in the flow direction of exhaust gas to be passed through the exhaust gas aftertreatment system caused by an amount of reductant to be added via a DeNOx element of a respective SCR catalyst differs from a predetermined catalyst threshold value the respective SCR catalyst is marked as defective, and wherein the control unit is configured to sequentially repeat the steps c) and d) for components of the exhaust gas aftertreatment system correspondingly present in multiplicate.

It may be provided that the control unit comprises an engine control unit and/or a control unit for an exhaust gas aftertreatment system and that stored on the control unit is a computer program product comprising a program code which configures the control unit to perform the proposed process when the program is activated and run on the control unit.

In a further aspect the proposed invention therefore relates to a computer program product comprising a program code which is stored on a machine-readable medium and configures a processing unit to perform the proposed process when the program code is run on the processing unit.

The proposed control unit has the same advantages as have been described in detail in connection with the proposed process. In particular, the control unit is used for performing the proposed process using the proposed computer program product.

BRIEF DESCRIPTION OF THE DRAWINGS

Further advantages, features and details of the invention are apparent from the description which follows in which exemplary embodiments of the invention are described in detail with reference to the drawings. The features recited in the claims and in the description may be essential features of the invention individually and by themselves or in any desired combination.

In the drawings.

DETAILED DESCRIPTION

Figure 1:
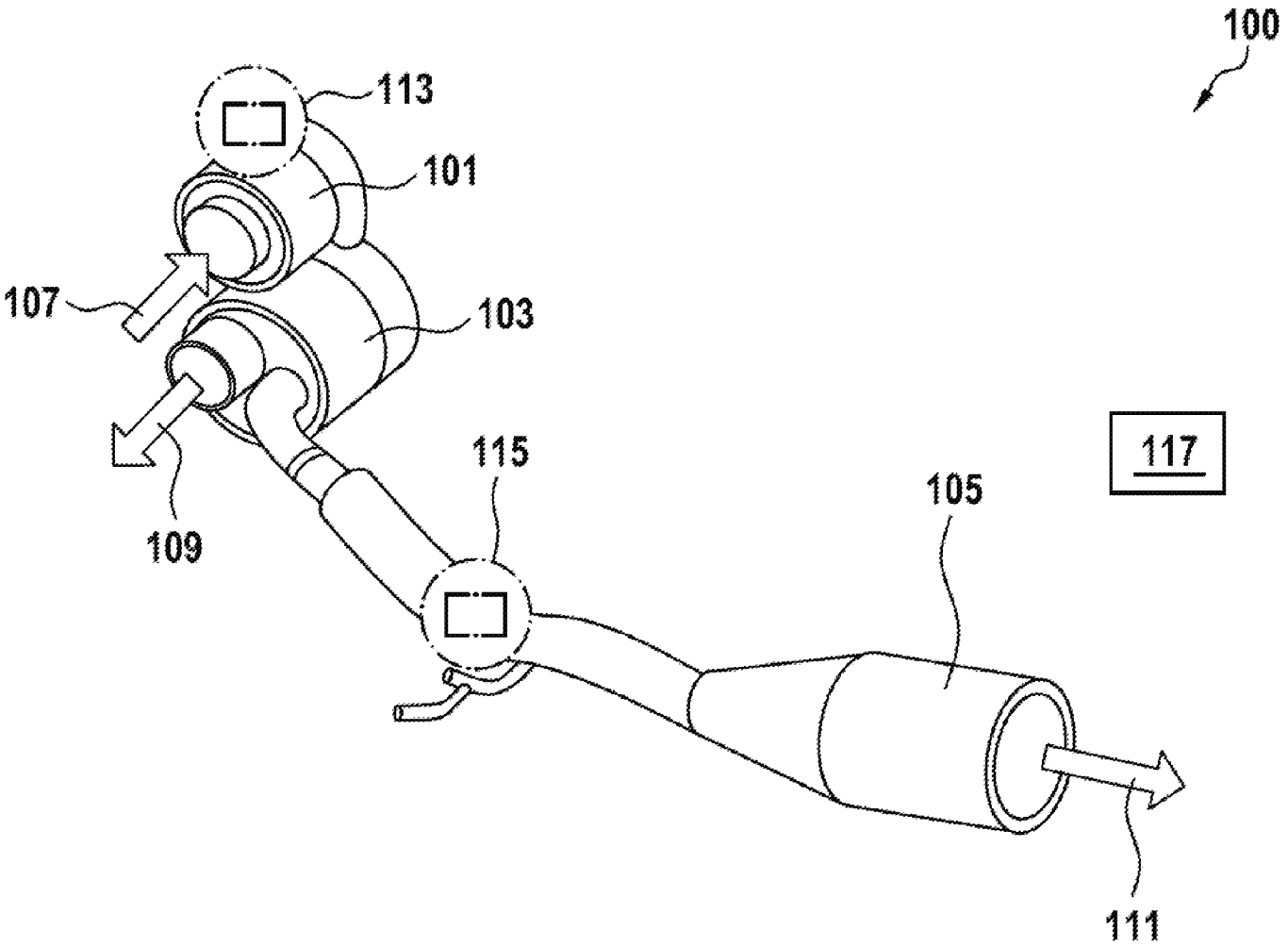
FIG. 1 shows a schematic diagram of a double injection exhaust gas aftertreatment system with a possible embodiment of the control unit according to the invention.

FIG. 1 shows an exhaust gas aftertreatment system 100.

The exhaust gas aftertreatment system 100 comprises an oxidation catalyst 101, a first SCR catalyst 103, in the form of a so-called "catalyst on particulate filter" and a second SCR catalyst 105 in the form of a so-called "catalyst under floor".

The exhaust gas aftertreatment system 100 is supplied with a flow of exhaust gas generated by an internal combustion engine as indicated by arrow 107; the exhaust gas flows downstream through the oxidation catalyst 101, through the first SCR catalyst 103 and optionally through an exhaust gas recirculation back into the internal combustion engine as indicated by arrow 109. Alternatively the exhaust gas flows further downstream in the direction of the second SCR catalyst 105 and finally exits the exhaust gas aftertreatment system 100 as indicated by arrow 111.

At a first point 113 a reductant may be added by a DeNOx element to reduce a concentration of NOx emissions in the exhaust gas.

At a second point 115 a reductant may be added by the same or a further DeNOx element to reduce a concentration of NOx emissions in the exhaust gas.

The exhaust gas aftertreatment system 100 is controlled by a control unit 117. The control unit 117 is configured for performing the proposed process for testing the exhaust gas aftertreatment system 100 as described for example with reference to FIG. 2 and FIG. 3. To this end, the control unit 117, which may be a central control unit of a vehicle for example, is communicatively connected to the exhaust gas aftertreatment system 100 via a communication interface.

Figure 2:
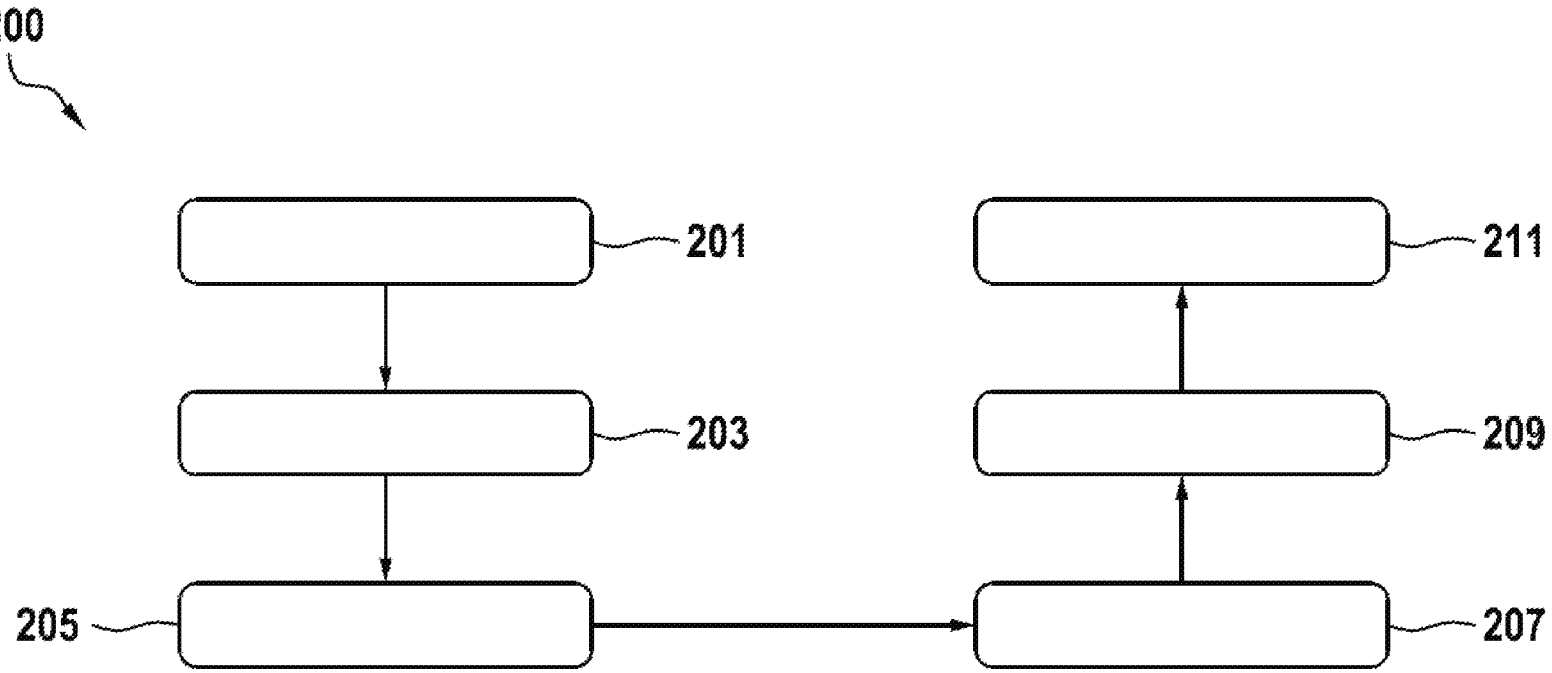
FIG. 2 shows a schematic diagram of a possible embodiment of the process according to the invention.

FIG. 2 shows the progression 200 of a possible embodiment of the proposed process.

In an activation step 201 a control unit for performing testing of an exhaust gas aftertreatment system is activated.

In a conditioning step 203 respective SCR catalysts of the exhaust gas aftertreatment system are heated above a predetermined threshold value by the control unit using an internal combustion engine to empty them of reductants.

In a sensor testing step 205 respective NOx sensors of the exhaust gas aftertreatment system are tested, wherein if a deviation of measured values determined by a respective NOx sensor from a reference value is greater than a predetermined threshold value the respective NOx sensor is marked as defective.

In a DeNOx system testing step 207 respective DeNOx systems of the exhaust gas aftertreatment system are tested, wherein if a change in measured values determined by a respective NOx sensor caused by an amount of reductant added via a respective DeNOx element is smaller than a predetermined threshold value the respective DeNOx element is marked as defective. It is provided that the NOx sensor is arranged downstream of the respective DeNOx element in the flow direction of exhaust gas to be passed through the exhaust gas aftertreatment system.

In an SCR catalyst testing step 209 a storage capacity of respective SCR catalysts is tested for a reductant, wherein if a change in measured values determined by a respective NOx sensor arranged downstream of the respective DeNOx element in the flow direction of exhaust gas to be passed through the exhaust gas aftertreatment system caused by an amount of reductant added via a DeNOx element of a respective SCR catalyst differs from a predetermined catalyst threshold value, i.e. for example respective measured values determined by the NOx sensor are lower than a predetermined catalyst threshold value which is indicative of an excessively large amount of added reductant, or higher than a predetermined catalyst threshold value which is indicative of an excessively small amount of added reductant, the respective SCR catalyst is marked as defective.

A catalyst threshold value upon which the SCR catalyst testing step 209 is based may comprise a minimum duration which must elapse from a time point of adding reductant to the SCR catalyst to be tested to a change in corresponding measured values determined by a NOx sensor arranged downstream of the SCR catalyst in the flow direction. This duration may be chosen according to a desired target capacity for example.

A catalyst threshold value upon which the SCR catalyst testing step 209 is based may alternatively or in addition comprise an absolute threshold value which may be chosen for example according to a target capacity of the SCR catalyst. In case of a maximum change in the measured values from the NOx sensor that is greater than the absolute threshold value, it can be assumed that the SCR catalyst does not have the target capacity and is thus to be marked as defective.

A catalyst threshold value upon which the SCR catalyst testing step 209 is based may alternatively or in addition comprise a progression threshold value which may be chosen for example according to a target capacity of the SCR catalyst. In case of a change in the measured values from the NOx sensor corresponding to a progression that differs from the progression threshold value, it can be assumed that the SCR catalyst does not have the target capacity and is thus to be marked as defective. To this end a gradient function or a derivative function of the progression of the measured values may be evaluated for example.

In an outputting step 211 error codes determined during steps 203 to 209 are outputted via an outputting unit such as for example a display in a vehicle.

Figure 3:
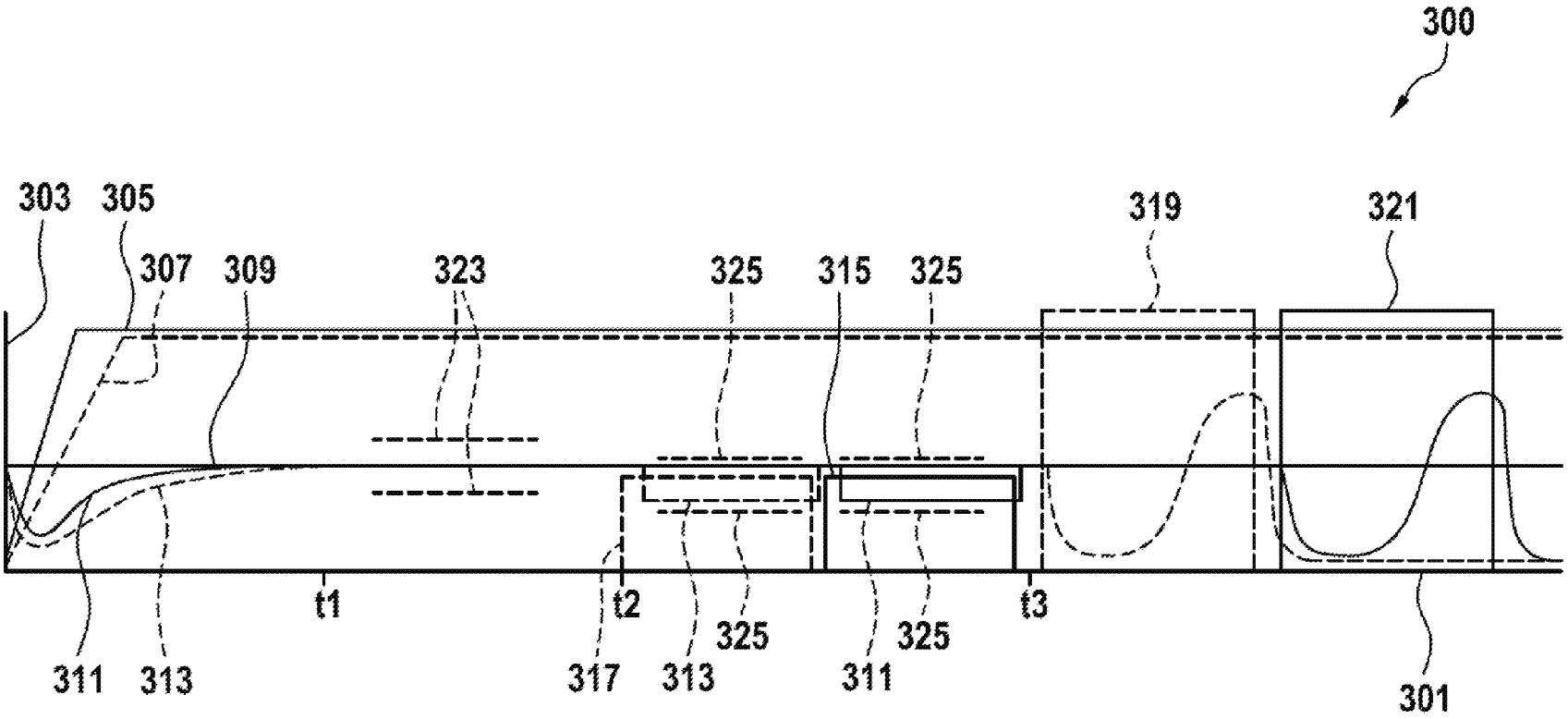
FIG. 3 shows a schematic diagram of the course over time of a possible embodiment of the process according to the invention.

FIG. 3 shows a diagram 300. The diagram 300 shows time along its abscissa 301 and a concentration along its ordinate 303 including respective signals 309, 311 and 313.

The diagram 300 shows various progression curves of different substances used in an exhaust gas aftertreatment system. It accordingly shows a first temperature progression 305 of a first SCR catalyst, for example an SCR catalyst on filter (SCRoF), and a second temperature progression 307 of a second SCR catalyst, for example an under-floor SCR catalyst (ufSCR), a concentration progression 309 of nitrogen oxides upstream of the first SCR catalyst, a concentration progression 311 of nitrogen oxides between the SCRoF catalyst and the ufSCR SCR catalyst and a concentration progression 313 of nitrogen oxides downstream of the ufSCR catalyst.

Starting from a commencement time point the proposed process commences with a conditioning phase in which the SCRoF catalyst and the ufSCR catalyst are emptied of reductant. This is achieved by heating the SCRoF catalyst and the ufSCR catalyst as is apparent from the first temperature progression 305 and the second temperature progression 307. A residual amount of reductant in the SCRoF catalyst and the ufSCR catalyst causes the concentration 311 of the nitrogen oxides between the SCRoF catalyst and the ufSCR catalyst and the concentration 313 downstream of the ufSCR catalyst to fall briefly, before then rising again with increasing emptying of the first SCRoF catalyst and the second SCR catalyst.

At a time point t1 when the SCRoF catalyst and the ufSCR catalyst are fully empty, respective NOx sensors of the exhaust gas aftertreatment system are tested in a first testing phase. To this end, measured values from the NOx sensors may be compared with a reference value, for example with a value determined via a NOx sensor model or with a measured value determined by a NOx sensor arranged upstream of the SCRoF catalyst. Should a NOx sensor determine measured values showing a deviation from respective reference values greater than a predetermined threshold value 323, the NOx sensor may be marked as defective. To this end, an error code may be stored in an error storage means of, for example, a control unit of the exhaust gas aftertreatment system or a control unit of the defective sensor.

At a time point t2 DeNOx systems of the exhaust gas aftertreatment system are tested in a second testing phase. To this end a first amount of reductant 315 is added to the SCRoF catalyst using a first DeNOx system of the SCRoF catalyst and a second amount of reductant 317 is added to the ufSCR catalyst using a second DeNOx element of the ufSCR catalyst.

If the first amount of reductant 315/the second amount of reductant 317 results in a change in measured values of the concentration 311/313 determined by a respective NOx sensor which is smaller than a threshold value 325 chosen according to the first amount of reductant 315/the second amount of reductant 317, the respective DeNOx element is marked as defective. To this end, an error code may be stored in an error storage means of, for example, a control unit of the exhaust gas aftertreatment system or a control unit of the defective DeNOx system.

The threshold value 325 shown here consists of an upper threshold value and a lower threshold value. At an excessively high addition amount the lower threshold value is exceeded downwards. At an excessively low addition amount the higher threshold value is exceeded upwards, i.e. the reduction in NOx values is not sufficiently achieved.

Accordingly, when the measured value is outside a range defined by the upper and lower threshold of the threshold value 325 the respective DeNOx system is marked as defective.

In the second testing phase an efficiency/a precision of a DeNOx system may be tested.

Moreover if a respective DeNOx element is marked as defective, further error diagnosis, for example in so-called pinpointing processes, can be performed for diagnosis at component level for example.

In a third testing phase a storage capacity of the SCRoF catalyst and of the ufSCR catalyst for reductant is tested at a time point t3. The third testing phase is preferably performed after the first testing phase and after the second testing phase, since correctly functioning NOx sensors and DeNOx systems are required for performing the third testing phase.

To test the ufSCR catalyst a first test amount of reductant 319 is added to the ufSCR catalyst. To test the SCRoF catalyst a second test amount of reductant 321 is added to the SCRoF catalyst.

If the first test amount of reductant 319 results in a change in the concentration progression 313 which is smaller than a threshold value chosen according to the first test amount of reductant 319 the ufSCR catalyst is marked as defective. The change is determined over a time chosen according to a volume of the ufSCR catalyst.

If the second test amount of reductant 321 results in a change in the concentration progression 311 which is smaller than a catalyst threshold value which is chosen according to the second test amount of reductant 321 and for example according to a known progression for a target capacity, the SCRoF catalyst is marked as defective. The change is determined over a time chosen according to a volume of the SCRoF catalyst.

Alternatively, the catalyst threshold value may be for example an absolute threshold value or a minimum duration that must elapse between a time point of addition of the reductant and a change in the measured values.

The first test amount of reductant 319 and the second test amount of reductant 321 are chosen such that they are superstoichiometric and for example correspond to double the amount of reductant necessary for reduction of a nitrogen oxide concentration present in the exhaust gas stream. A defective SCR catalyst is apparent from an increase in a nitrogen oxide concentration downstream of the SCR catalyst which indicates slip of reductant from the SCR catalyst.

In order to avoid unconverted reductant passing through to a downstream component, for example an SCR catalyst, and interfering with testing thereof it is especially provided that a test sequence of components of the exhaust gas aftertreatment system commences with a respective component arranged furthest from an exhaust gas source in the flow direction of exhaust gas to be passed through the exhaust gas aftertreatment system before respective subsequent components in the direction of the exhaust gas source are tested successively.

It is alternatively possible to commence a testing sequence of components of the exhaust gas aftertreatment system with a respective component closest to an exhaust gas source since this is subject to particularly high temperatures owing to its position relative to the exhaust gas source and is correspondingly failure prone.

In the case of a successive analysis of the components starting from a downstream end of the exhaust gas system the entire process may be performed with only one conditioning step. In the case of a successive analysis of the components starting from an upstream end of the exhaust gas system a defect in a component arranged in a position particularly near relative to the exhaust gas source is detected particularly rapidly. Accordingly, a sequence of components respectively to be tested may be chosen according to an objective.

Finally all results from the respective testing phases are logged and stored in a storage means/outputted via an outputting unit.

The invention claimed is:

1. A process for testing a plurality of components of an exhaust gas aftertreatment system, wherein the plurality of components comprises a first SCR catalyst and at least one further SCR catalyst arranged downstream of the first SCR catalyst in the flow direction of exhaust gas to be passed through the exhaust gas aftertreatment system, a first NOx sensor assigned to the first SCR catalyst and at least one further NOx sensor assigned to the at least one further SCR catalyst, and a first DeNOx element assigned to the first SCR catalyst and at least one further DeNOx element assigned to the at least one further SCR catalyst, and wherein the process comprises at least the following steps:

a) conditioning the SCR catalysts, wherein the SCR catalysts are heated above a predetermined threshold value to empty them of reductants using an internal combustion engine, b) testing the NOx sensors, wherein if a deviation of measured values determined by a respective NOx sensor from a reference value is greater than a predetermined threshold value the respective NOx sensor is marked as defective, c) testing the DeNOx elements, wherein if a change in measured values determined by a respective NOx sensor caused by an amount of reductant added via a respective DeNOx element is larger or smaller than a threshold value chosen according to the added amount of reductant the respective DeNOx element is marked as defective, wherein the NOx sensor is arranged downstream of the respective DeNOx element in the flow direction of exhaust gas to be passed through the exhaust gas aftertreatment system, d) testing a storage capacity for the reductant of the SCR catalysts, wherein if a change in measured values to be determined by a respective NOx sensor arranged downstream of the respective DeNOx element in the flow direction of exhaust gas to be passed through the exhaust gas aftertreatment system caused by an amount of reductant to be added via a DeNOx element of a respective SCR catalyst differs from a predetermined catalyst threshold value, the respective SCR catalyst is marked as defective, wherein the predetermined catalyst threshold value corresponds to a target storage capacity for the reductant of the SCR catalysts value and includes a temporal threshold value, wherein the change in the measured values occurs before a time duration associated with the temporal threshold value elapses, the respective SCR catalyst is marked as defective, wherein the temporal threshold value is a minimum time duration from a time point of addition of the reductant to the change in the measured values, and wherein the steps c) and d) are sequentially repeated for the components of the exhaust gas aftertreatment system correspondingly present in multiplicate.

2. The process according to claim 1, wherein the catalyst threshold value comprises a predetermined time point after an addition time point for addition of the amount of reductant, a single value for comparison with an absolute value of the change in the measured values from the NOx sensor is evaluated in step d) and/or a value progression for comparison with an increase in the change in the measured values from the NOx sensor is evaluated in step d).

3. The process according to claim 1, wherein initially all the NOx sensors are tested in step b), subsequently all the DeNOx systems are tested in step c) and finally all the SCR catalysts are tested in step d).

4. The process according to claim 1, wherein the sequential repetition of the steps c) and d) commences with a respective component arranged furthest from an exhaust gas source in the flow direction of exhaust gas to be passed through the exhaust gas aftertreatment system before respective subsequent components in the direction of the exhaust gas source are tested successively or commences with a respective component arranged closest to an exhaust gas source in the flow direction of exhaust gas to be passed through the exhaust gas aftertreatment system before respective subsequent components in the flow direction are tested successively.

5. The process according to claim 1, wherein step d) comprises adding a superstoichiometric amount of reductant to a respective SCR catalyst to be tested.

6. The process according to claim 1, wherein if a respective DeNOx element is marked as defective in step c) the respective DeNOx element is tested using a test method in an additional step e) to determine a defective component of the DeNOx system.

7. The process according to claim 1, wherein the process is performed in a servicing mode of an internal combustion engine comprising the exhaust gas aftertreatment system.

8. A control unit for performing the process according to claim 1, wherein the control unit is configured for performing the steps a) to d).

9. The control unit according to claim 8, wherein the control unit is configured for performing testing of a plurality of components of an exhaust gas aftertreatment system, wherein the plurality of components comprises a first SCR catalyst and at least one further SCR catalyst arranged downstream of the first SCR catalyst in the flow direction of exhaust gas to be passed through the exhaust gas aftertreatment system, a first NOx sensor assigned to the first SCR catalyst and at least one further NOx sensor assigned to the at least one further SCR catalyst and a first DeNOx element assigned to the first SCR catalyst and at least one further DeNOx element assigned to the at least one further SCR catalyst and wherein the control unit is configured for performing at least the following steps:

a) conditioning the SCR catalysts by heating the SCR catalysts above a predetermined threshold value to empty them of reductants using an internal combustion engine to be controlled by the control unit, b) testing the NOx sensors, wherein if a deviation of measured values to be determined by a respective NOx sensor from a reference value is greater than a predetermined threshold value the respective NOx sensor is marked as defective, c) testing the DeNOx elements, wherein if a change in measured values determined by a respective NOx sensor caused by an amount of reductant added via a respective DeNOx element is larger or smaller than a threshold value chosen according to the added amount of reductant the respective DeNOx element is marked as defective, d) testing a storage capacity for the reductant of the SCR catalysts, wherein if a change in measured values to be determined by a respective NOx sensor arranged downstream of the respective DeNOx element in the flow direction of exhaust gas to be passed through the exhaust gas aftertreatment system caused by an amount of reductant to be added via a DeNOx element of a respective SCR catalyst differs from a predetermined catalyst threshold value the respective SCR catalyst is marked as defective, wherein the predetermined catalyst threshold value corresponds to a target storage capacity for the reductant of the SCR catalysts value and includes a temporal threshold value, wherein the change in the measured values occurs before a time duration associated with the temporal threshold value elapses, the respective SCR catalyst is marked as defective, wherein the temporal threshold value is a minimum time duration from a time point of addition of the reductant to the change in the measured values, and wherein the control unit is configured to sequentially repeat the steps c) and d) for the components of the exhaust gas aftertreatment system correspondingly present in multiplicate.

10. The control unit according to claim 8, wherein the control unit comprises an engine control unit, a control unit, or both, for an exhaust gas aftertreatment system and stored on the control unit is a computer program product comprising a program code which configures the control unit to perform the process when the program is activated and run on the control unit.

11. A computer program product comprising a program code which is stored on a machine-readable medium and configures a processing unit to perform the process according to claim 1 when the program code is run on the processing unit.

12. The process according to claim 2, wherein initially all the NOx sensors are tested in step b), subsequently all the DeNOx systems are tested in step c) and finally all the SCR catalysts are tested in step d).

13. The process according to claim 12, wherein the sequential repetition of the steps c) and d) commences with a respective component arranged furthest from an exhaust gas source in the flow direction of exhaust gas to be passed through the exhaust gas aftertreatment system before respective subsequent components in the direction of the exhaust gas source are tested successively or commences with a respective component arranged closest to an exhaust gas source in the flow direction of exhaust gas to be passed through the exhaust gas aftertreatment system before respective subsequent components in the flow direction are tested successively.

14. The process according to claim 13, wherein step d) comprises adding a superstoichiometric amount of reductant to a respective SCR catalyst to be tested.

15. The process according to claim 14, wherein if a respective DeNOx element is marked as defective in step c) the respective DeNOx element is tested using a test method in an additional step e) to determine a defective component of the DeNOx system.

16. The process according to claim 15, wherein the process is performed in a servicing mode of an internal combustion engine comprising the exhaust gas aftertreatment system.

17. A control unit for performing the process according to claim 16, wherein the control unit is configured for performing the steps a) to d).

* * * * *